United States Patent [19]

Schulze

[11] Patent Number: 5,033,447

[45] Date of Patent: Jul. 23, 1991

[54] SUPPORT APPARATUS

[76] Inventor: John C. Schulze, 3 Sievers Ext. Rd., Vincennes, Ind. 47591

[21] Appl. No.: 619,593

[22] Filed: Nov. 29, 1990

[51] Int. Cl.[5] ..... B24B 53/12

[52] U.S. Cl. ..... 125/11.01; 51/217 A; 125/8; 269/901

[58] Field of Search ..... 125/11.01, 11.02, 8; 51/216 R, 216 A, 217 R, 217 A, 218 A, 166 TS; 269/101, 189, 8

[56] References Cited

U.S. PATENT DOCUMENTS

| | | | |
|---|---|---|---|
| Re. 26,920 | 6/1970 | Parapetti | 125/11.01 |
| 1,915,247 | 6/1933 | Holloway et al. | 51/218 A |
| 2,452,398 | 10/1948 | Smith | 125/11.03 |
| 2,644,277 | 7/1953 | Chatten | 125/11.21 |
| 2,998,683 | 9/1961 | Wegener | 51/216 R |
| 4,303,054 | 12/1981 | Lore | 125/11.01 |

*Primary Examiner*—Robert A. Rose
*Attorney, Agent, or Firm*—Leon Gilden

[57] ABSTRACT

A clamping apparatus for mounting and positioning a diamond type dressing stone in proximity to a grinding wheel is provided to permit adjustable orientation of the dressing stone relative to the grinding wheel. The apparatus includes a support block adjustably mounted to an upper positioning block through a parallel link structure utilizing clamping rods directed orthogonally adjacent post terminal ends of clamping links to secure the upper block in a relative position relative to the support block.

5 Claims, 4 Drawing Sheets

PRIOR ART

SUPPORT APPARATUS

BACKGROUND OF THE INVENTION

1. Field of the Invention

The field of invention relates to clamping and positioning apparatus, and more particularly pertains to a new and improved support apparatus for mounting and maintaining a diamond dressing stone in proximity and relative to an associated grinding wheel during a dressing procedure.

2. Description of the Prior Art

Maintenance of grinding wheels typically requires a stone directed across the surface of a rotating grinding wheel to remove debris and the like accumulated during use of the grinding wheel. The instant invention attempts to overcome deficiencies of the prior art by providing a support apparatus wherein the same mounts and adjustably positions a dressing stone proximate to a grinding wheel. Examples of prior art clamping and positioning apparatus may be found in U.S. Pat. No. 2,486,765 to Snyder wherein a hydraulic motivated clamp structure mounts a rock member proximate to a rock saw to permit selective cutting of the rock work piece.

U.S. Pat. No. 2,416,703 to Marshall sets forth a crystal fixture wherein radially mounted clamps secure a crystal member for subsequent operation on that crystal member.

U.S. Pat. No. 4,111,180 to Goodrich sets forth a rock holding fixture or device wherein a finger member is cooperative with a plurality of services to effect a clamping of a rock as desired.

U.S. Pat. No. 3,168,893 to Johnson sets forth a stone cutting vice wherein a calibrated jaw structure is arranged for mounting a stone prior to a cutting procedure.

U.S. Pat. No. 2,420,790 to Moeller sets forth a further example of a stone cutting clamp utilizing spaced jaws to selectively clamp and position a stone therebetween.

As such, it may be appreciated that there continues to be a need for a new and improved support apparatus as set forth by the instant invention which addresses both the problems of ease of use as well as effectiveness in construction in positioning a dressing diamond type stone relative to a grinding wheel for a dressing procedure and in this respect, the present invention substantially fulfills this need.

SUMMARY OF THE INVENTION

In view of the foregoing disadvantages inherent in the known types of clamping apparatus now present in the prior art, the present invention provides a support apparatus wherein the same positions and mounts a diamond or other equivalent stone such as from the carbide family in a fixture relative to a grinding wheel for effecting dressing and cleaning of the grinding wheel. As such, the general purpose of the present invention, which will be described subsequently in greater detail, is to provide a new and improved support apparatus which has all the advantages of the prior art clamping apparatus and none of the disadvantages.

To attain this, the present invention provides a clamping apparatus for mounting and positioning a diamond type dressing stone in proximity to a grinding wheel to permit adjustable orientation of the dressing stone relative to the grinding wheel. The apparatus includes a support block adjustably mounted to an upper positioning block through a parallel link structure utilizing clamping rods directed orthongonally adjacent post terminal ends of clamping links to secure the upper block in a relative position relative to the support block.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved support apparatus which has all the advantages of the prior art support apparatus and none of the disadvantages.

It is another object of the present invention to provide a new and improved support apparatus which may be easily and efficiently manufactured and marketed.

It is a further object of the present invention to provide a new and improved support apparatus which is of a durable and reliable construction.

An even further object of the present invention is to provide a new and improved support apparatus which is susceptible of a low cost of manufacture with regard to both materials and labor, and which accordingly is then susceptible of low prices of sale to the consuming public, thereby making such support apparatus economically available to the buying public.

Still yet another object of the present invention is to provide a new and improved support apparatus which provides in the apparatuses and methods of the prior art some of the advantages thereof, while simultaneously overcoming some of the disadvantages normally associated therewith.

Still another object of the present invention is to provide a new and improved support apparatus wherein the same adjustable mounts an upper support block relative to a lower support block in a parallel relationship to adjustable position a dressing type stone such as from the carbide family relative to a grinding wheel for a dressing operation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
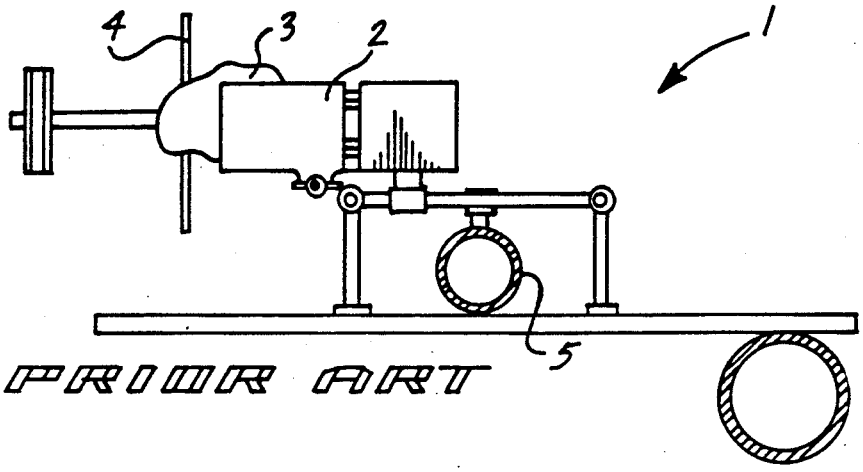
FIG. 1 is an orthographic side view of a prior art clamping structure.

With reference now to the drawings, and in particular to FIGS. 1 to 7 thereof, a new and improved support apparatus embodying the principles and concepts of the present invention and generally designated by the reference numeral 10 will be described.

Figure 2:
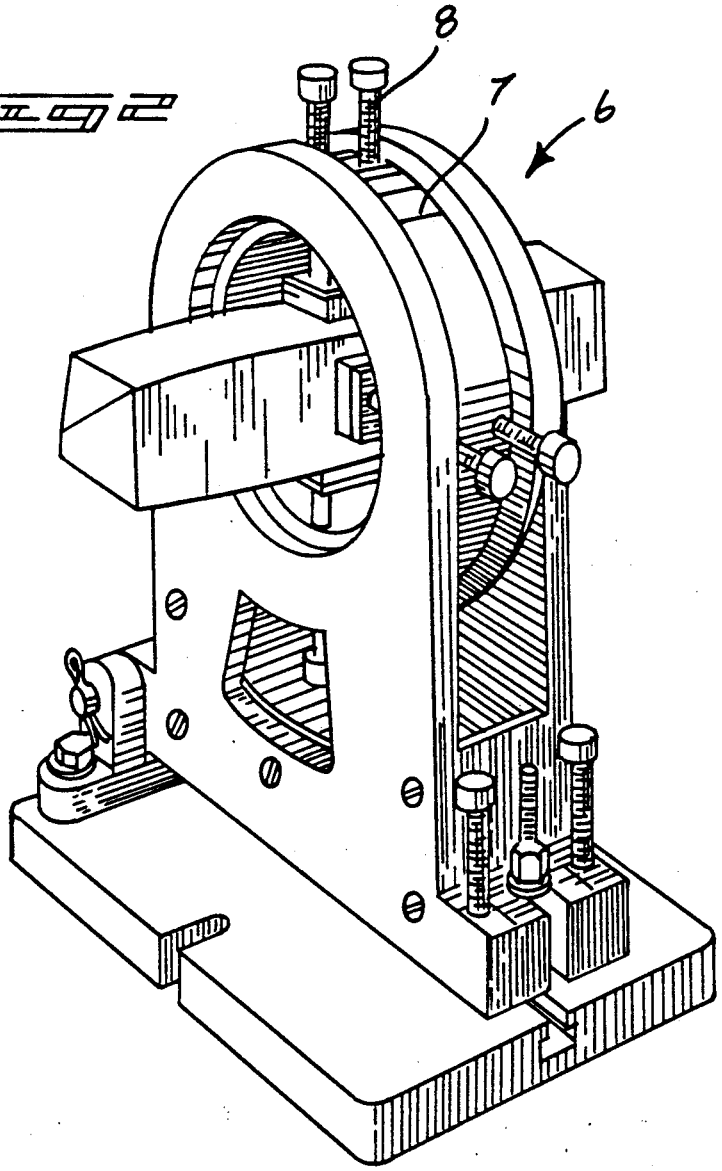
PRIOR ART FIG 2
FIG. 2 is an isometric illustration of a further example of a prior art clamping structure.
Figure 3:
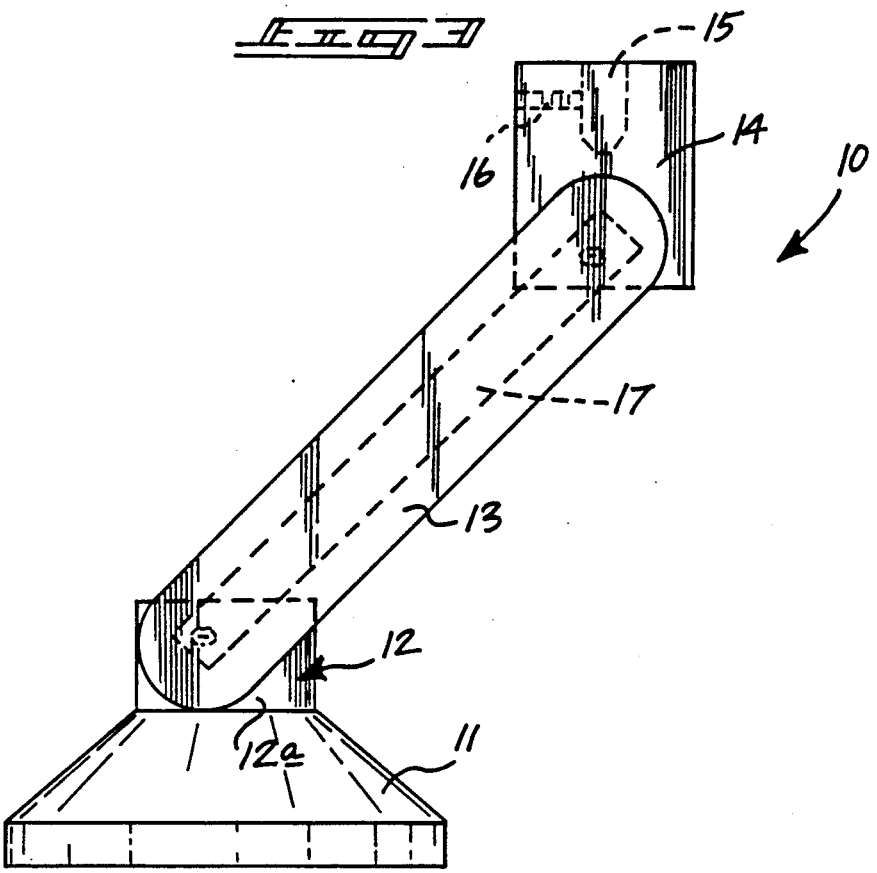
FIG. 3 is an orthographic side view, taken in elevation, of the instant invention.
Figure 4:
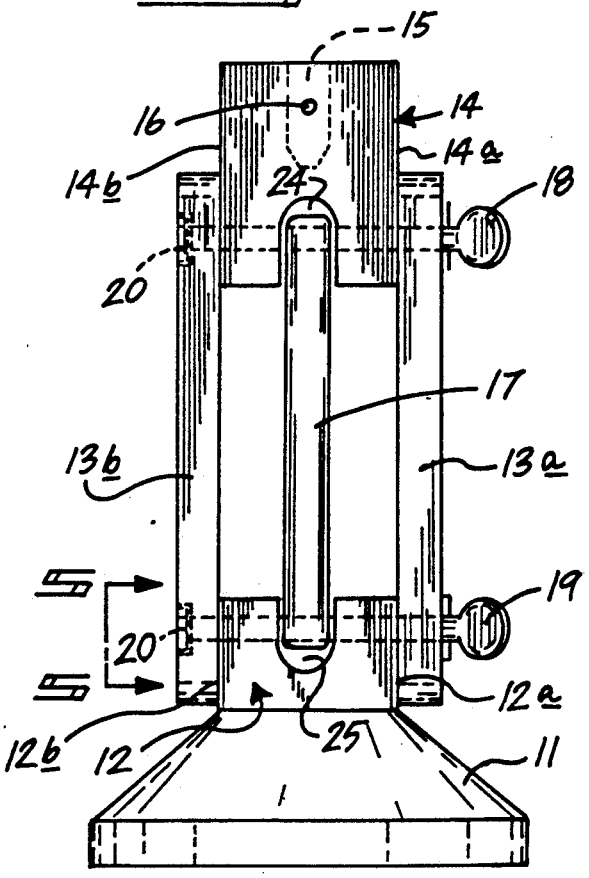
FIG. 4 is an orthographic frontal view of the instant invention taken in elevation.
Figure 5:
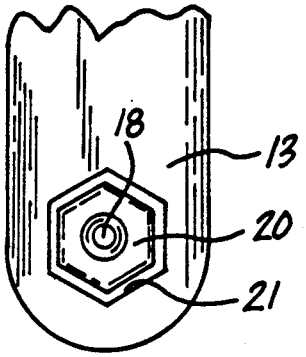
FIG. 5 is an orthographic view, taken along the lines 5—5 of FIG. 4 in the direction indicated by the arrows.

FIG. 1 illustrates a prior art clamping apparatus 1, wherein a plurality of jaws 2 mount a rock member 3 for positioning relative to a saw 4 utilizing hydraulic pressure through a cylinder organization 5, in a manner as set forth in U.S. Pat. No. 2,486,765. FIG. 2 sets forth an isometric illustration of a further example of a prior art connecting structure 6, wherein a crystal member is mounted within an opening directed through a framework 7, wherein a radially operative clamp 8 clamp the structure prior to various machining and dressing procedures, such as may be utilized in cooperation with a cutting tool.

Figure 6:
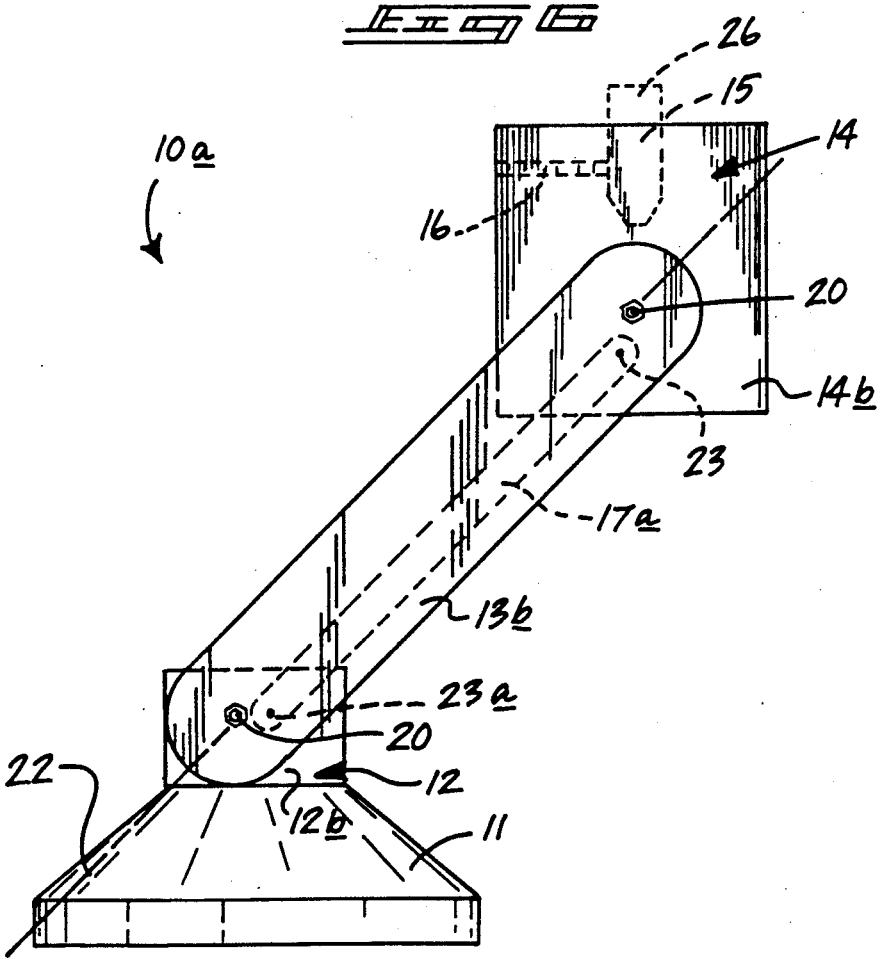
FIG. 6 is an orthographic side view, taken in elevation, of a modification of the instant invention.
Figure 7:
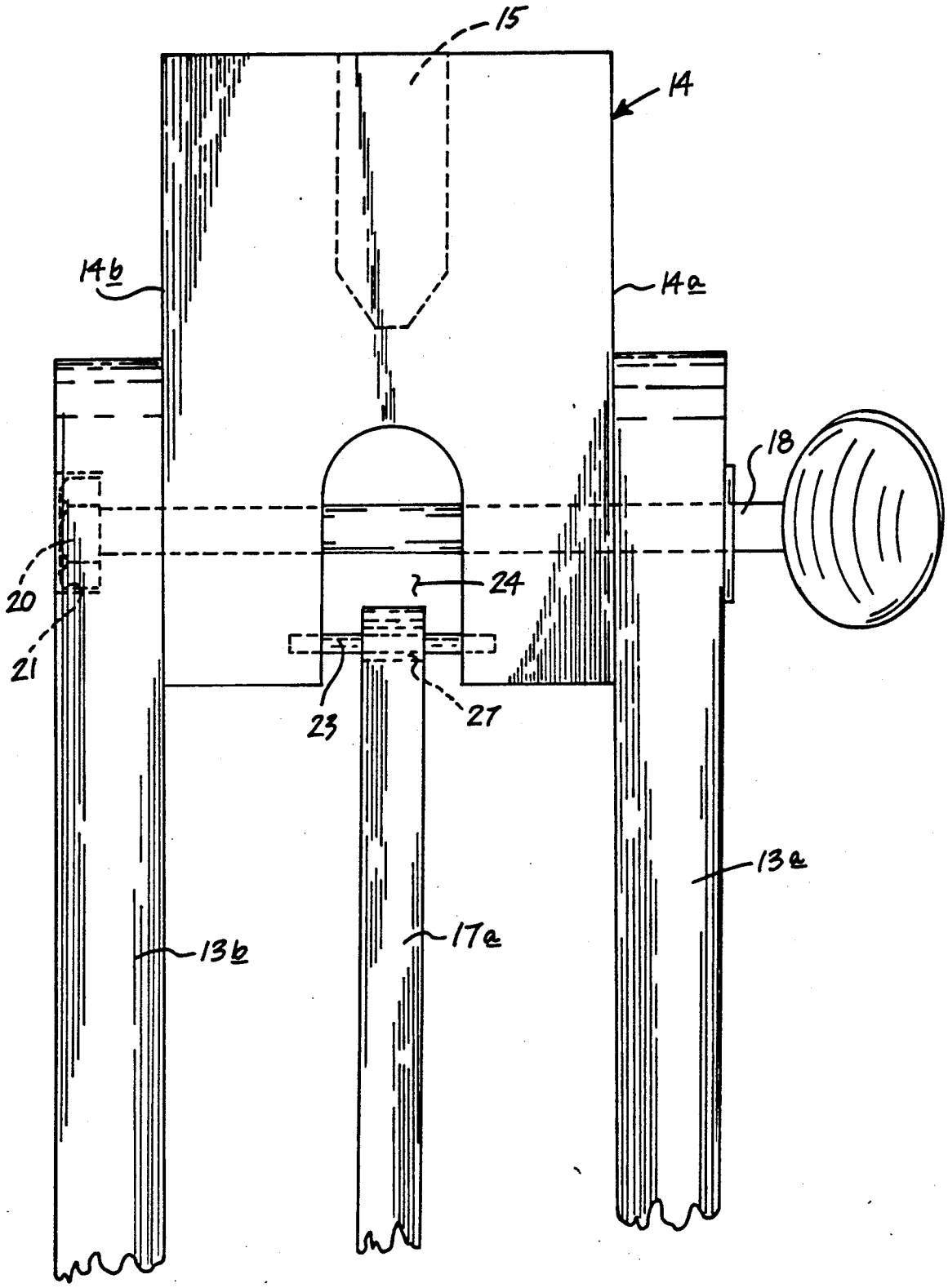
FIG. 7 is an enlarged orthographic frontal view of the mounting of the positioning link relative to the upper positioning block of the instant invention as set forth in FIG. 6.

More specifically, the support apparatus 10 of the instant invention essentially comprises a support base 11 fixedly mounting a support block 12 to a top surface of the support bench. The support block 12 includes spaced parallel respective right and left sides **12*a* and 12*b*. An upper positioning block 14 is adjustably mounted above the support block 12 and includes cooperating and respective right and left parallel sides 14*a* and 15*b* spaced an equal spacing as defined between the right and left sides 12*a* and 12*b*. Right and left clamping plates 13*a* and 13*b* extend pivotally between the right and left sides of the support block 12 and the upper positioning block 14, with the right clamping plate 13*a* extending between the right sides 12*a* and 14*a* and the left clamping plate 13*b* extending between the left sides 12*b* and 14*b* of the respective support block and the upper positioning block 14. An upper and lower block screw 18 and 19 extend orthogonally through the right and left clamping plates and the associated support blocks, as illustrated. The left clamping plate 13*b* includes a hexagonal lock nut 20 fixedly mounted within a counter-sunk hexagonal bore 21 that is formed within the left clamping plate 13*b* and coaxially aligned with each respective upper and lower lock screw 18 and 19. A positioning link 17 is received within an upper and lower block cavity 24 and 25 respectively of the upper positioning block 14 and the support block 12 respectively. As illustrated, the upper and lower block cavities 24 and 25 are in coaxially alignment relative to one another receiving the upper and lower terminal ends of the position link 17 therewithin, with the upper and lower lock screws 18 and 19 orthogonally directed through the respective upper and lower terminal ends of the link 17 to permit pivotment and adjustment of the upper positioning block 14 relative to the support block 12. The upper positioning block 14 includes a nib supporting bore 15 orthogonally directed through a top thereof, with a set screw orthogonally directed through a side wall of the upper positioning block 14 and orthogonally oriented relative to the support bore 16 to secure and maintain a diamond nib or an equivalent (see FIG. 6) within the cavity and for the positioning of such a nib or dressing stone relative to an associated grinding wheel (not shown). FIGS. 6 and 7 illustrate the use of a modified support apparatus 10*a*, wherein a modified positioning link 17*a* is axially parallel to and offset a clamping plate plane 22 that is medially directed through the right and left clamping plates 13*a* and 13*b* directed through the upper and lower lock screws 18 and 19. The upper terminal end of the modified link 17*a* includes a slotted pin cavity 27 to receive the upper pivot pin 23, with a lower pivot pin 23*a* directed through the lower terminal end orthogonally therethrough of the modified link 17*a*. The offset link provides enhanced leveraged positioning of the upper positioning block 14 relative to the support block 12** in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clamping and support apparatus for mounting a grinding wheel dressing bit therewithin, comprising, a support base, the support base including a support block mounted thereon, the support block including parallel right and left support block sides spaced apart a predetermined spacing, and an upper positioning block mounted above the support block including upper positioning block right and left sides spaced apart the predetermined spacing, and a right clamping plate mounted to the support block right side and the upper positioning block right side, and a left clamping plate mounted to the support block left side and the upper positioning block left side, and an upper lock screw means orthogonally directed through the right and left clamping plates and the upper position block orthogonally therethrough, and a lower lock screw means orthogonally directed through the right and left clamping plates capturing the support block therebetween, and the upper positioning block including a support bore orthogonally directed through a top surface of the upper positioning block, and clamping means directed through the upper positioning block and orthogonally directed into the support bore for securing the dressing bit therewithin.

2. An apparatus as set forth in claim 1 wherein the upper positioning block includes an upper block cavity directed through a bottom wall thereof, and the support block includes a lower block cavity directed through a top wall of the support block, and a positioning link mounted within the upper and lower block cavity, wherein the positioning link is arranged parallel to and between the right and left clamping plates.

3. An apparatus as set forth in claim 2 wherein a positioning link includes an upper positioning link bore and a lower positioning link bore, wherein the upper positioning bore receives the upper lock screw orthogonally therethrough, and the lower link bore includes the lower lock screw orthogonally therethrough.

4. An apparatus as set forth in claim 2 wherein the positioning link includes an upper pivot pin mounted orthogonally through the positioning link adjacent an upper terminal end thereof, wherein the upper pivot pin is mounted within the upper block cavity, and wherein the positioning link includes a slotted upper pin cavity to receive the upper pivot pin therethrough, and a lower pivot pin orthogonally directed through the positioning link adjacent the lower terminal end of the positioning link, with the lower pivot pin mounted within the lower block cavity, and a clamping plate plane is defined through the upper and lower lock screws coextensively within the right and left clamping plates, and the positioning link is arranged parallel to and spaced from the clamping plate plane.

5. An apparatus as set forth in claim 4 wherein the left clamping plate includes an upper and lower hexagonal bore coaxially aligned with each respective upper and lower lock screw, and each counter-sunk bore includes a hexagonal lock nut fixedly mounted therewithin to receive the respective upper and lower lock screw therewithin to permit securement and clamping of the right and left clamping plate to the support block and positioning block.

* * * * *